United States Patent [19]

Luke

[11] Patent Number: 4,723,561

[45] Date of Patent: Feb. 9, 1988

[54] SMOKING ARTICLES

[75] Inventor: John A. Luke, Eastleigh, England

[73] Assignee: British-American Tobacco Company, Ltd., London, England

[21] Appl. No.: 945,720

[22] Filed: Dec. 22, 1986

[30] Foreign Application Priority Data

Dec. 23, 1985 [GB] United Kingdom ..... 8531659

[51] Int. Cl.[4] ..... A24D 3/04; A24C 5/47

[52] U.S. Cl. ..... 131/336; 131/94; 493/42; 493/43

[58] Field of Search ..... 131/336, 94, 95; 493/41, 42, 43

[56] References Cited

U.S. PATENT DOCUMENTS 4,362,171 12/1982 Johnson et al. ..... 131/336
4,527,573 7/1985 Hausermann ..... 131/336
4,593,707 6/1986 Seidel et al. ..... 131/336
4,611,607 9/1986 Reynolds et al. ..... 131/336

*Primary Examiner*—V. Millin
*Attorney, Agent, or Firm*—Charles G. Lamb

[57] ABSTRACT

A cigarette comprises a tobacco rod and a filter element of porous filtration material having an air permeable surface and equiangularly spaced lengthwise extending peripheral ventilation grooves. The element and the rod are interattached by a first air-impermeable wrapper which can extend into and line the grooves. A second wrapper is wrapped about the element and extends from the downstream end thereof for a distance short of the upstream ends of the grooves. The second wrapper does not line the grooves where it extends thereover. Ventilation air is then able to enter the upstream ends of the grooves not covered by the second wrapper and flow therealong. Ventilation is thereby achieved without the necessity for tipping wrapper perforations. A method of making such cigarettes is also disclosed.

13 Claims, 7 Drawing Figures

SMOKING ARTICLES

This invention relates to smoking articles comprising ventilated mouthpieces.

Numerous proposals have been made in the patent literature for filter tipped cigarettes in which ventilation air may pass through perforations in a tipping wrapper to depressions formed in the periphery of the filter tip. In United Kingdom Patent Specification No. 2 115 678 A ventilation air may flow from such depressions into the interior of the filter tip. Alternatively, in accordance with the teaching of that specification peripheral depressions of the filter tip can take the form of grooves which extend to the mouth end of the tip. In the latter case ventilation air flows along the grooves and exits therefrom at the mouth end of the tip.

A significant determinant of the degree of ventilation of a filter tipped cigarette of the type above mentioned is the pressure drop of which the air is subject in the passage thereof through the tipping wrapper perforations. The pressure drop value is dependent upon the size of the perforations and the number of perforations per unit area. It is currently a common practice to produce the perforations during the cigarette manufacturing process by means of, for example, a laser perforating apparatus. In order to ensure that the specified ventilation value is consistently attained, the cigarettes must be continually tested and the perforating apparatus must be appropriately adjusted if by the test procedure there is detected a drift away from the specified ventilation value. These test and feedback procedures are complex and should there be a failure of them, even if only of short duration, the result, at the high speed of operation of modern cigarette machinery, may be the production of a large number of faulty cigarettes.

Proposals have been made for providing for the ingress of ventilation air to tipped cigarettes other than by resort to tipping wrapper perforations.

In European Patent Specification No. 059040 there are described filter tipped cigarettes in which the tipping wrapper is provided at its inner side with ventilation air grooves extending from the end of the wrapper remote the mouth end of the filter tip. The grooves serve to conduct air either to a location at which the air passes into the interior of the filter tip, or directly to the mouth end of the tip. These cigarettes are of complex construction and the diameter at the outer surface of the tipping is significantly in excess of the diameter of the cigarette rod. The latter feature is not only open to criticism on aesthetic grounds, but would give rise to machine handling and packaging problems.

In U.S. Pat. No. 3,608,561 there is disclosed filter extender means for optional attachment of a filter to a cigarette by the smoker. The extender means takes the form of a tubular housing, the filter being contained within the housing at one end thereof. An end of a cigarette to which the filter is to be attached is inserted into the housing at the other end thereof and is pushed into the housing until the end of the cigarette abuts the filter. The housing is provided with inner, longitudinally extending ridges which, where they contact the cigarette, compress the cigarette and thereby create channels adjacent the ridges. According to the teaching of U.S. Pat. No. 3,608,561, although these channels are minute, they may serve as air channels. Clearly, such filter extender means does not have application to commercial cigarette manufacture.

Filter tipped cigarettes disclosed in U.S. Pat. No. 4,387,728 comprise a filter tip provided with external grooves extending to the end of the tip which abuts the cigarette rod. A narrow tipping band is used to interattach the filter tip and the cigarette rod and portions of the external grooves are overlain by the band. When such a cigarette is smoked air passes from the grooves into the cigarette rod.

Another prior proposal for providing for ventilation air ingress other than through tipping wrapper perforations is contained in United Kingdom Patent Specification No. 2 016 256 A. According to the teaching of this specification, the tipping wrapper web is cut longitudinally before being wrapped about a double cigarette assembly. In the resultant cigarettes a first portion of tipping wrapper serves to interattach the filter tip and the cigarette rod and a second portion of tipping wrapper, spaced from the first portion, is wrapped only about the filter tip. The continuous annular space between the two portions of tipping wrapper is intended to permit the ingress of ventilation air. It is a defect of this proposal that if the first portion of tipping wrapper extends over the filter tip for a sufficient proportion of the length thereof to ensure adequately secure attachment of the filter tip to the cigarette rod, the air ingress space between the two portions of tipping wrapper may be disposed at a location of the filter tip which is likely to be contacted by the fingers of the smoker during the smoking of the cigarette, in which case the air ingress space would be at least partly obturated.

In U.S. Pat. No. 1,718,122 there is disclosed a plain, i.e. non-filter tipped, cigarette comprising at a mouth end portion two ventilation grooves pressed into the cigarette paper. A wrapper extends about the mouth end portions of the cigarette and covers the grooves except for end portions thereof remote the mouth end of the cigarette. It is a defect of this proposal, which to the best of Applicant's knowledge has never been put into practice, that it is difficult to obtain properly defined and permanent grooves in cigarette paper. Moreover, as the cigarette is smoked the cigarette paper at the upstream ends of the grooves would become dampened by the deposit thereon of condensing vapours driven off from the tobacco near to the burning coal. This would result in the removal of the "set" of the cigarette paper necessary to preserve the form of the grooves and thus the grooves would be likely to become closed.

It is an object of the present invention to provide for the ventilation of a smoking article, a cigarette for example, at a mouthpiece element thereof, other than through tipping perforations, whilst also providing for fully secure attachment of the mouthpiece element to the smoking material rod and for flexibility in the positioning lengthwise of the mouthpiece element of the location of initial air ingress.

The present invention provides a smoking article comprising a smoking material rod, a mouthpiece element, a depression extending lengthwise of said element at the periphery thereof and being disposed substantially wholly within the lengthwise dimension of said element, a first wrapper interattaching said rod and said element and a second wrapper wrapped about said element and extending from the downstream end of said depression for a distance short of the upstream end of said depression, an upstream end portion of said depression being open to permit the flow of ventilation air along said depression beneath said second wrapper.

As used herein, the term "mouthpiece element" refers to an element incorporated in a smoking article at the mouth end thereof, which element, or a portion thereof, may take the form of a filter.

The depression may extend to the upstream and/or to the downstream end of the mouthpiece element.

Preferably, the first wrapper is substantially air impermeable. It is also preferable that the first wrapper extends into and lines the depression. If the depression extends to the downstream end of the mouthpiece element, the first wrapper may line the depression over the full length thereof.

Suitably, the second wrapper is substantially air impermeable. Advantageously, the second wrapper extends close to the upstream end of the depression.

The mouthpiece element may take the form of a plug of filtration material, fibrous cellulose acetate for example, into which the depression has been impressed. Such a plug may be self-sustaining or alternatively the plug may be wrapped in air permeable plugwrap.

The present invention further provides a method of making smoking articles, wherein a double unit length mouthpiece element is assembled with first and second smoking material rods to provide a double smoking article assembly, first wrapper means is wrapped about said assembly to interattach said first and second rods and said element, thermal moulding means is applied at each half of said element to provide at each said half a lengthwise extending depression, second wrapper means is wrapped about said element, said second wrapper means extending in each said half of said element from the middle of said element for a distance short of the end of the depression remote the middle of said element, and said assembly is severed at the middle of said element.

Preferably, the application of the thermal moulding means results in the depression being lined by the first wrapper means.

In order that the present invention may be clearly understood and readily carried into effect reference will now be made, by way of example, to the accompanying diagrammatic drawings, in which.

Figure 1:
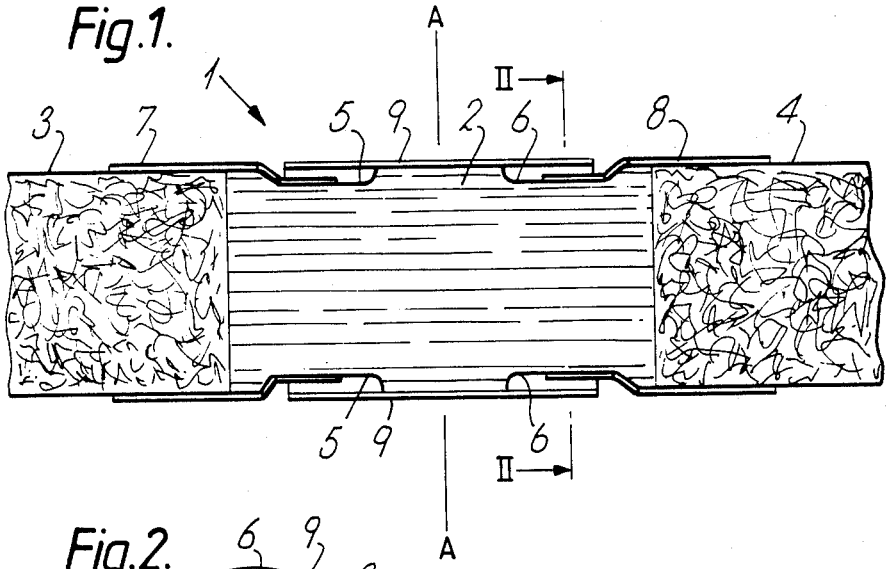
FIG. 1 shows, in axial section, a double cigarette assembly.

The double cigarette assembly shown in FIG. 1 and generally designated by the reference numeral 1 comprises a self-sustaining filter plug 2 of fibrous cellulose acetate and first and second tobacco rods 3 and 4, only parts of which rods are shown. The filter plug 2 comprises in each half thereof four equiangularly spaced peripheral depressions which take the form of lengthwise extending grooves 5 and 6.

Figure 2:
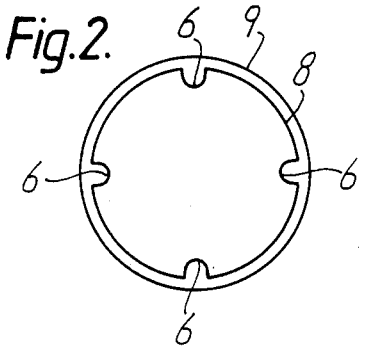
FIG. 2 shows a sectional view taken at line II—II of FIG. 1.

First wrappers 7 and 8 of air impermeable paper serve to interattach the filter plug 2 and the tobacco rods 3 and 4 respectively. As may be seen from FIG. 1, each of the first wrappers 7,8 extends along the plug 2 for about a quarter of the length of the plug 2. As may also be seen from FIG. 1 and, in regard to the right hand half of the plug 2, also from FIG. 2, the first wrappers 7,8 extend into and line portions of the grooves 5,6 respectively.

A second, air impermeable paper wrapper 9 is wrapped about the filter plug 2. The wrapper 9 extends over each half of the plug 2 for a distance from the middle of the plug which is short of the ends of the grooves 5,6 remote the middle of the plug 2. The wrapper 9, unlike the wrappers 7,8, does not extend into the grooves 5,6.

The double cigarette assembly 1 is made as follows. The filter plug 2, in an ungrooved condition, is disposed between, axially aligned with, and abutted to, the tobacco rods 3,4. The first wrappers 7,8 are wrapped about respective end portions of the plug 2 and adjacent portions of the tobacco rods 3,4. The grooves 5,6 are then formed by pressing heated formers into the plug 2. Because the grooves are formed over a proportion of the lengths thereof at locations of the plug 2 enwrapped in the first wrappers 7,8, the groove forming process provides grooves lined over the aforesaid proportion of the lengths thereof by the wrappers 7,8. The grooves 5,6 may be formed using thermal moulding apparatus generally of the character disclosed in United Kingdom Patent Specification No. 1,507,765.

Because the groove formation process involves the application of heat to the wrappers 7,8, these wrappers are of a thermoplastic character. The material of the wrappers 7,8 may, for example, comprise a proportion of thermoplastic fibres. Suitable wrapper materials are disclosed in European Patent Specification No. 119693.

Figure 3:
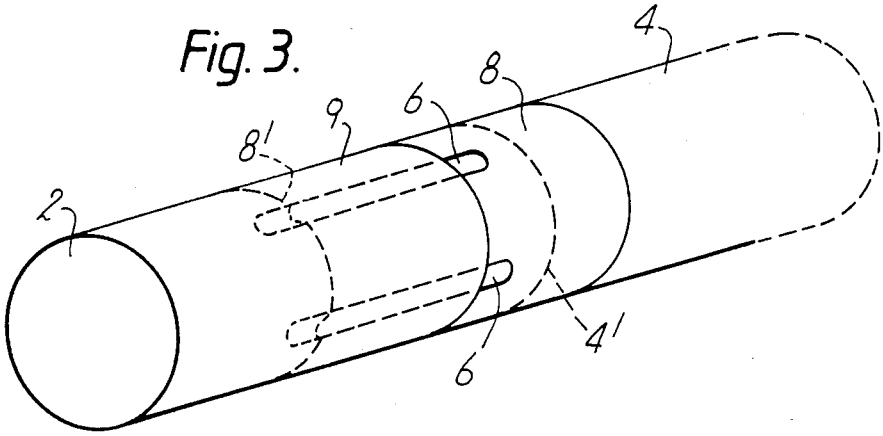
FIG. 3 shows a perspective view of a cigarette derived from the double assembly of FIG. 1.

After completion of the groove formation process, the second wrapper 9 is wrapped about the filter plug 2. Subsequently, the double cigarette assembly is severed at the middle plane thereof, indicated by the line A-A of FIG. 1, to provide separate cigarettes as per the cigarette of FIG. 3. In FIG. 3 the broken lines 4' and 8' represent respectively the juncture of rod 4 and plug 2 and the downstream edge of wrapper 8.

When the cigarette of FIG. 3 is smoked, ventilation air is drawn into the upstream end portions of the grooves 6 which are not overlain by the wrapper 9. The air passes down the grooves 6 to the downstream end portions thereof which are not lined by the wrapper 8 and then passes through the walls of the grooves 6 into the body of the filter plug 2, where the air comes into contact with smoke being drawn from the tobacco rod 4. The ventilation air cannot pass from the grooves 6 into the plug 2 before reaching the downstream end portions of the grooves 6 because of the air impermeable character of the wrapper 8.

Because of the thermoplastic character of the wrapper 8 and of the underlying cellulose acetate filter plug 2, the thermal process used for forming the grooves 6 results in a well-defined and permanent groove conformation.

Figure 4:
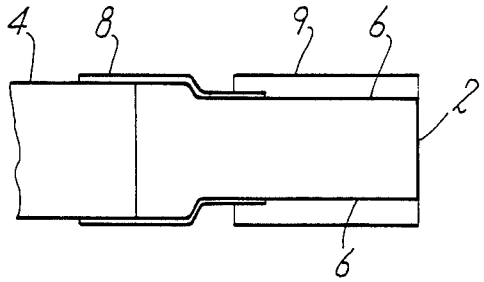
FIGS. 4 to 6 show variant forms of the cigarette of FIG. 3.
Figure 5:
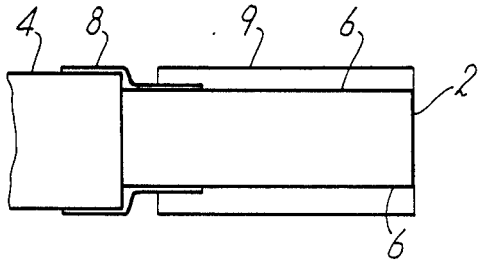
Figure 6:
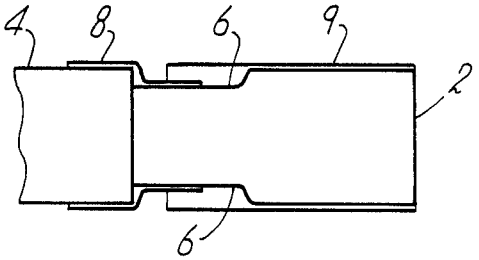

In that the cigarettes of FIGS. 4 to 6 are variants of the form of cigarette of FIG. 3, the same reference numerals have been used for the same components in all four of these figures.

In the FIG. 4 cigarette the grooves 6 extend to the mouth end of the filter plug 2 and in the FIG. 5 cigarette the grooves 6 extend over the full length of the filter plug 2. When the cigarettes of FIGS. 4 and 5 are smoked, ventilation air issues from the downstream ends of the grooves 6 and mixes in the smoker's mouth with tobacco smoke passing from the end face of the plug 2. If in these cigarettes it is required to ensure that no mixing of air and smoke can occur until each exits the mouth end of the cigarette, the filter plug 2 can be provided with an impermeable plugwrap enwrapping the plug 2 and lining the grooves 6. Alternatively, the impermeable wrapper 8 can extend to the mouth end of the plug 2. In the latter case a single first wrapper is wrapped about the plug 2 and adjacent portions of the two tobacco rods prior to the above-mentioned groove formation step.

The FIG. 6 cigarette varies from that of the Figure 3 cigarette in that in the former the grooves 6 extend to the upstream end of the filter plug 2.

Figure 7:
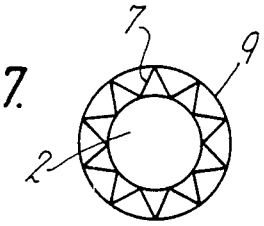
FIG. 7 shows a filter end view of a cigarette.

FIGS. 4 to 6 can also represent further variant forms of cigarettes in accordance with the present invention. In these additional variant forms the reference numeral 6 designates an annular space between the wrapper 9 and a reduced diameter portion of the plug 2. Within such annular space 6 there may be disposed bracing means such, for example, as a pleated sheet material bracing means 10 seen in end view in FIG. 7.

What is claimed is:

1. A smoking article comprising a smoking material rod, a mouthpiece element, a depression extending lengthwise of said element at the periphery thereof and being disposed substantially wholly within the lengthwise dimension of said element, the periphery of the element having the depression formed therein being air permeable, a first wrapper interattaching said rod and said element and a second wrapper wrapped about said element and extending from the downstream end of said depression for a distance short of the upstream end of said depression, an upstream end portion of said depression being open to permit the flow of ventilation air along said depression beneath said second wrapper.

2. A smoking article as claimed in claim 1, wherein said depression extends to the upstream end of said element.

3. A smoking article as claimed in claims 1 or 2, wherein said depression extends to the downstream end of said element.

4. A smoking article as claimed in claims 1, wherein said first wrapper is substantially air impermeable.

5. A smoking article as claimed in claims 1 or 4, wherein said first wrapper extends into and lines said depression.

6. A smoking article as claimed in claim 5, wherein said first wrapper lines said depression over the full extent thereof.

7. A smoking article as claimed in claim 1, wherein said first wrapper comprises a proportion of thermoplastic material.

8. A smoking article as claimed in claim 1, wherein said second wrapper is substantially air impermeable.

9. A smoking article as claimed in claims 1 or 8, wherein said second wrapper extends close to the upstream end of said depression.

10. A smoking article as claimed in claim 1, wherein said depression is in the form of an annular groove.

11. A smoking article as claimed in claim 10, wherein bracing means is disposed in the annular space between said second wrapper and the walls of said groove.

12. A method of making smoking articles, wherein a double unit length mouthpiece element is assembled with first and second smoking material rods to provide a double smoking article assembly, first wrapper means is wrapped about said assembly to interattach said first and second rods and said element, thermal moulding means is applied at each half of said element to provide at each said half a lengthwise extending depression, second wrapper means is wrapped about said element, said second wrapper means extending in each said half of said element from the middle of said element for a distance short of the end of the depression remote the middle of said element, and said assembly is severed at the middle of said element.

13. A method of making smoking articles as claimed in claim 12, wherein the application of said thermal moulding means results in the depression being lined by said first wrapper means.

* * * * *